US007335840B2

(12) United States Patent
Young et al.

(10) Patent No.: US 7,335,840 B2
(45) Date of Patent: Feb. 26, 2008

(54) SAFETY APPARATUS IN CONNECTION WITH WORK LOADING DEVICE TO SAFE GUARD MACHINE TOOLS OPERATION

(75) Inventors: Hong-Tsu Young, Taipei (TW); Ching-Chang Liao, Lujhou (TW); Ming-Shiue Jiang, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 11/124,072

(22) Filed: May 9, 2005

(65) Prior Publication Data

US 2006/0157329 A1 Jul. 20, 2006

(30) Foreign Application Priority Data

Jan. 14, 2005 (TW) ..... 94101274 A

(51) Int. Cl.
*H01H 9/20* (2006.01)

(52) U.S. Cl. ..... 200/43.04; 200/43.01

(58) Field of Classification Search .. 200/43.01–43.22, 200/50.01–50.04, 318–327, 17 R, 334
See application file for complete search history.

(56) References Cited

U.S. PATENT DOCUMENTS 4,107,484 A * 8/1978 Petersen, III ..... 200/43.04
4,176,264 A * 11/1979 Tann ..... 200/82 E
4,890,006 A * 12/1989 Huang ..... 307/112
5,357,070 A * 10/1994 Parsons, Jr. ..... 200/331
5,584,378 A * 12/1996 Wecke et al. ..... 200/43.04
5,760,353 A * 6/1998 Rapp ..... 200/17 R
6,373,004 B1 * 4/2002 Jackson ..... 200/50.1
6,861,597 B2 * 3/2005 Baechle ..... 200/43.04
6,872,898 B2 * 3/2005 Mohtasham ..... 200/43.01

* cited by examiner

*Primary Examiner*—Elvin Enad
*Assistant Examiner*—M. Fishman

(57) ABSTRACT

This invention is an installation of a safety apparatus to prevent safety problems of machine tools caused in work-loading process. The safety apparatus comprises an actuator, used for connecting circuits of the machine tool to control its power on-off status, and a storing unit to ensure the chuck wrench resting at a designated safe position. This safety system will activate the actuator when the chuck wrench is returned to the designated position and, therefore, it will keep the circuits of the machine tool stay active during the machining operation. On the other hand, this safety apparatus will remain in power-off status if the chuck wrench is not placed at the designated position and, therefore, it will make the power circuits open and paralyze the machine tool operation.

4 Claims, 3 Drawing Sheets

SAFETY APPARATUS IN CONNECTION WITH WORK LOADING DEVICE TO SAFE GUARD MACHINE TOOLS OPERATION

RELATED APPLICATIONS

The present application is based on, and claims priority from, Taiwanese Application Number 094101274, filed Jan. 14, 2005, the disclosure of which is hereby incorporated by reference herein in its entirety.

THE FIELD OF THE INVENTION

This invention is associated with a safety apparatus for preventing safety problems of machine tools, and especially related to a safety apparatus for preventing safety problems during machine tools operation caused in work-loading process.

THE BACKGROUND OF THE INVENTION

In work places of machining processing, for the purpose of making parts from raw materials, machine tools are necessary. Even up to now, most of the machine tools have been mainly operated and monitored on-line by operators. Thus, the safety measures are crucially important in the work places. As the operators turn on the machine tools, but are reckless enough not to remove non-operational subjects, for example T-shaped chuck wrench used for work loading, this results in operator's serious accidental injury. Therefore, enhancing the protective measures is a vital issue of safety improvement necessary in the work places where the machine tools exist. Moreover, this safety issue is more critical in the places where students take practical training.

Most of the means for enhancing the safety measures of machine tools is to install transparent safety masks or sensors around the machine tools. There is no otherwise positive protective measure. On the other hand, the protection received from transparent masks is limited. For one thing, the transparent masks build up a safety zone only in a specific area and provide partial protection; for the other, the protection from the safety mask is extremely weak. According to the experiences in the work places, the ejective angle and destructive power of a non-operational piece, for example a T-shaped chuck wrench, caused through operator's negligence, are far beyond what the transparent mask can control. It is obvious that a simple transparent mask cannot provide sufficient protection.

In other instances, to enhance the safety concerns of machine tools, some safety sensing device is adopted on the work bench of the machine tool. Somehow its sensing scope is constrained. For one thing, there are many dead zones for the safety sensor. Furthermore, the safety sensor cannot judge whether a non-operational subject, for example a T-shaped chuck wrench, has been removed to a relatively safe place. Especially for randomly placed work-loading device, for example a T-shaped chuck wrench, the safety sensor cannot identify its location in relation to operator's position. No base can then be established to judge whether a safety concern is to be raised. Hence, the abovementioned methods fail to provide an effective and positive protection for the operators in manipulating machine tools.

It is found that human factor dominates the occurrences of occupational injury. Thus, apart from giving an ideal pre-occupational safety training, the design of an effective and positive safety apparatus is a priority for the working environments where students are receiving practical training, which at the same time helps reduce the occupational injury to a minimal extent.

THE SUMMARY OF THE INVENTION

The goal of this invention is to provide a safety apparatus to prevent safety problems of machine tools caused in work-loading process. The safety apparatus comprises an actuator, used for connecting circuits of the machine tool to control its power on-off status, and a storing unit to ensure the chuck wrench resting at a designated safe position. This safety system will activate the actuator when the chuck wrench is returned to the designated position and, therefore, it will keep the circuits of the machine tool stay active during the machining operation. On the other hand, this safety apparatus will remain in power-off status if the chuck wrench is not placed at the designated position and, therefore, it will make the power circuits open and paralyze the machine tool operation.

THE EMBODIMENTS OF THE INVENTION

FIGS. 1(*a*) and 1(*b*) illustrate a concept of the safety apparatus of this invention. This safety apparatus 30 comprises an actuator 32, which is in series connected with the on-off switch of the circuits 40 to control the power status of the machine tool, and a storing unit 34 to ensure the chuck wrench resting at a designated safe position. This safety system will activate the actuator 32 when the chuck wrench is returned to the designated position and, therefore, it will keep the circuits of the machine tool stay active during the machining operation. On the other hand, this safety apparatus will remain in power-off status if the chuck wrench is not placed at the designated position and, therefore, it will make the power circuits open and paralyze the machine tool operation.

FIGS. 2(*a*) and 2(*b*) illustrate an embodiment of the safety apparatus of this invention. This safety apparatus 30 comprises an actuator 32, which is in series connected with the on-off switch of the circuits 40 of the machine tool to control the power status of the machine tool, and a storing unit 34, used to ensure the chuck wrench resting at a designated safe position. This safety system will activate the actuator 32 when the chuck wrench is returned to the designated position and, therefore, it will keep the circuits of the machine tool stay active during the machining operation. On the other hand, this safety apparatus will remain in power-off status if the T-shaped chuck wrench 50 is not placed at the designated position and, therefore, it will make the power circuits open and paralyze the machine tool operation. Thus, the work-loading device, T-shaped chuck wrench 50 must be placed at a fixed site on the storing unit 34, before the machine tool can be started. This preventive measure is implemented to safe guard the situation where the work-loading device, for example a T-shaped chuck wrench, remains in the work place through the operator's negligence. The basic mechanism for the control of the status of actuator 32—on (FIG. 2(*b*)) or off (FIG. 2 (*a*)) in the safety apparatus 30, is based on whether the work-loading device, for example a T-shaped chuck wrench 50, is returned to the designated position on the storing unit 34.

The actuator 32 may comprise a click-typed on-off switch 38, which is activated by the weight of the work-loading device, for example a T-shaped chuck wrench 50 on a lathe operation, to control the on-off status of the actuator 32. As the actuator 32 is in connection with the power circuits of the lathe in series, it directly controls the power status of the lathe operating system. The main feature of the present invention is to render the actuator 32 in power-off status if the chuck wrench is not placed at the designated position and, therefore, it will make the power circuits open and paralyze the lathe operation. The lathe may remain ineffective even when its power switch is pressed on.

FIG. 3 shows the flow chart for the embodiment of FIG. 2. The process flow encompasses the following steps:

STEP 100: turn on the power of the machine tool; execute STEP 102.

STEP 102: load the work to the chuck of machine tool, and then, execute STEP 104.

STEP 104: check whether the T-shaped chuck wrench 50 is placed on the storing unit 34; execute STEP 106, if "yes"; go to STEP 112, if "no".

STEP 106: turn on the actuator 32.

STEP 108: the machine tool stay effectively on, and execute STEP 110.

STEP 110: the machine tool is turned on.

STEP 112: the actuator 32 remains inactive, and execute STEP 114.

STEP 114: the machine tool stays ineffective, and execute STEP 116.

STEP 116: the machine tool operation is kept paralyzed, and the flow is ended.

In conclusion, as the T-shaped chuck wrench 50 is placed on the storing unit 34, which simultaneously switches on the actuator 32, the operational system of the machine tool is made effective. On the other hand, this safety apparatus will remain in power-off status if the chuck wrench is not placed at the designated position and, therefore, it will make the power circuits open and paralyze the machine tool operation.

This invention provides a safety apparatus to prevent safety problems of a machine tool caused in work-loading process, and provides a safety mechanism for the operation mode of the machine tool. Damages to the machine tool and human injury can then be further reduced if normal safety procedures are taken in conjunction with this safety apparatus.

Through the abovementioned preferable description of the embodiments of this invention, hopefully the features and main spirit are clearly described. But the description doesn't limit the scope of this invention. From other viewpoint, the purpose of this description is made to cover any change or equivalent rearrangement within the scope of this invention.

Figure 1:
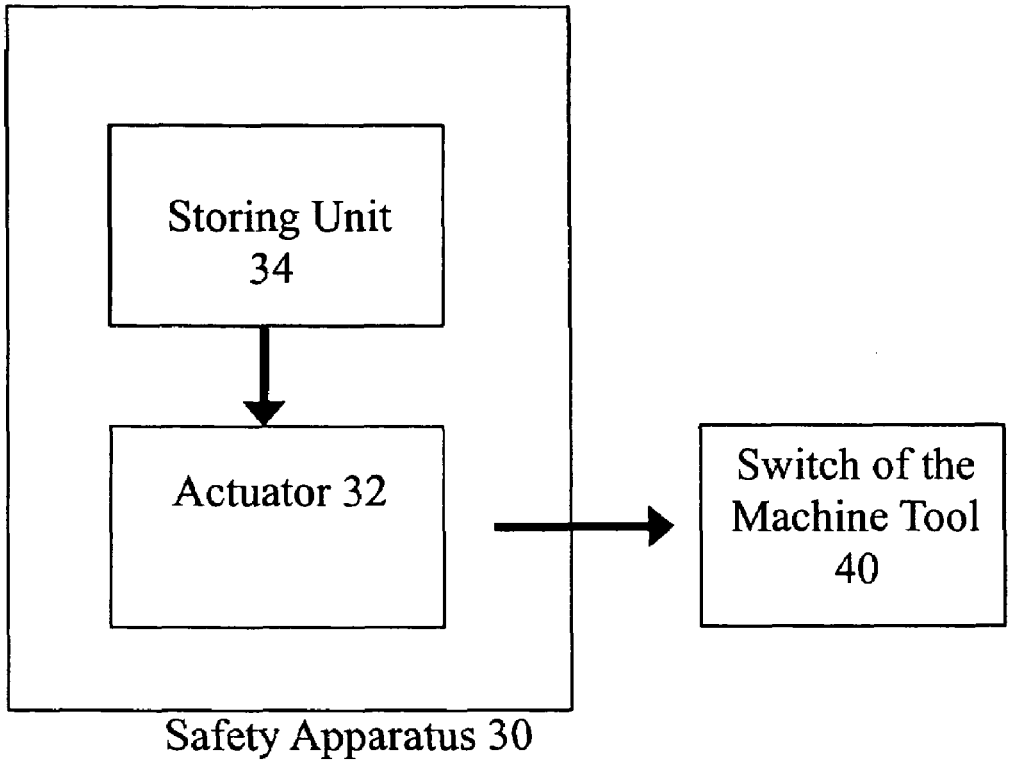
FIGS. 1(*a*) and 1(*b*) illustrate a concept of the safety apparatus of this invention.
Figure 1:
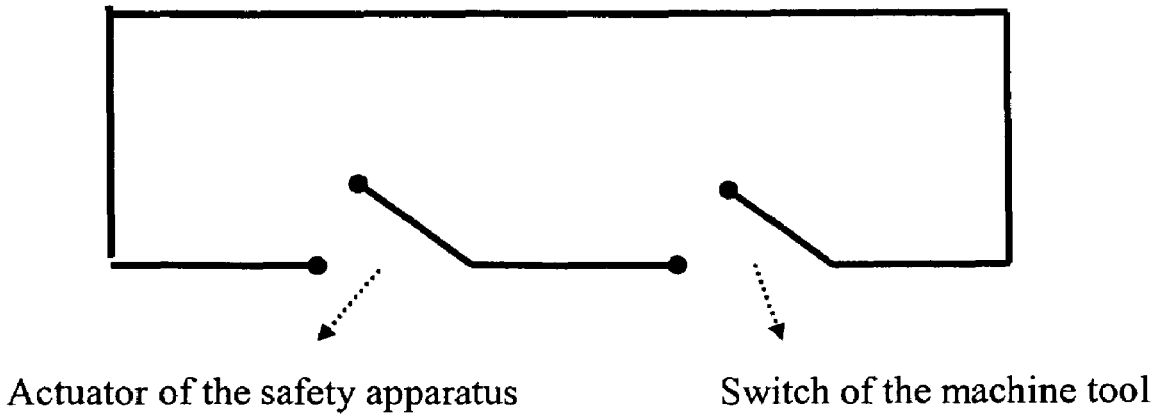
Figure 2:
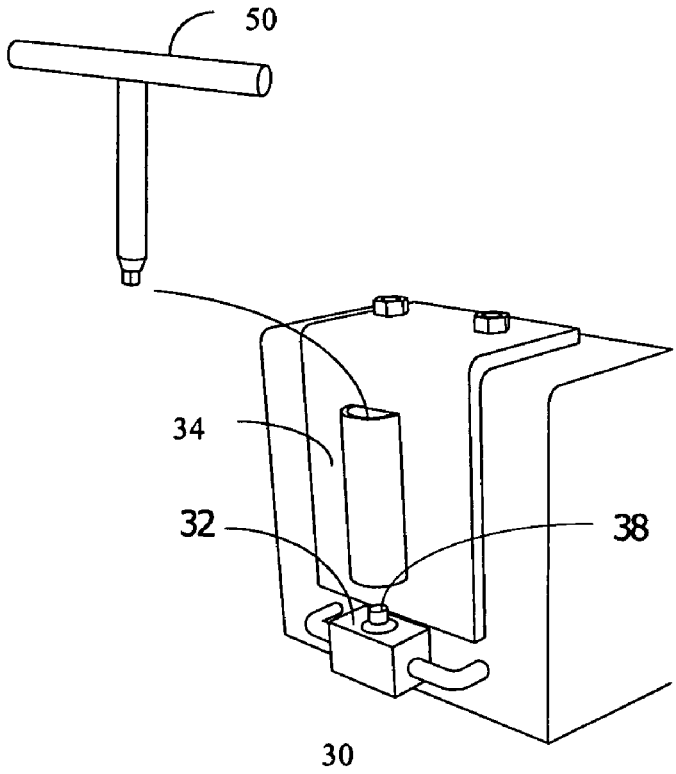
FIGS. 2(*a*) and 2(*b*) illustrate an embodiment of the safety apparatus of this invention.
Figure 2:
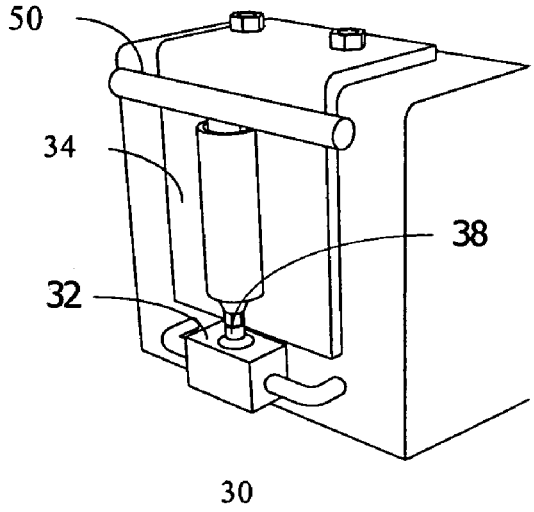
Figure 3:
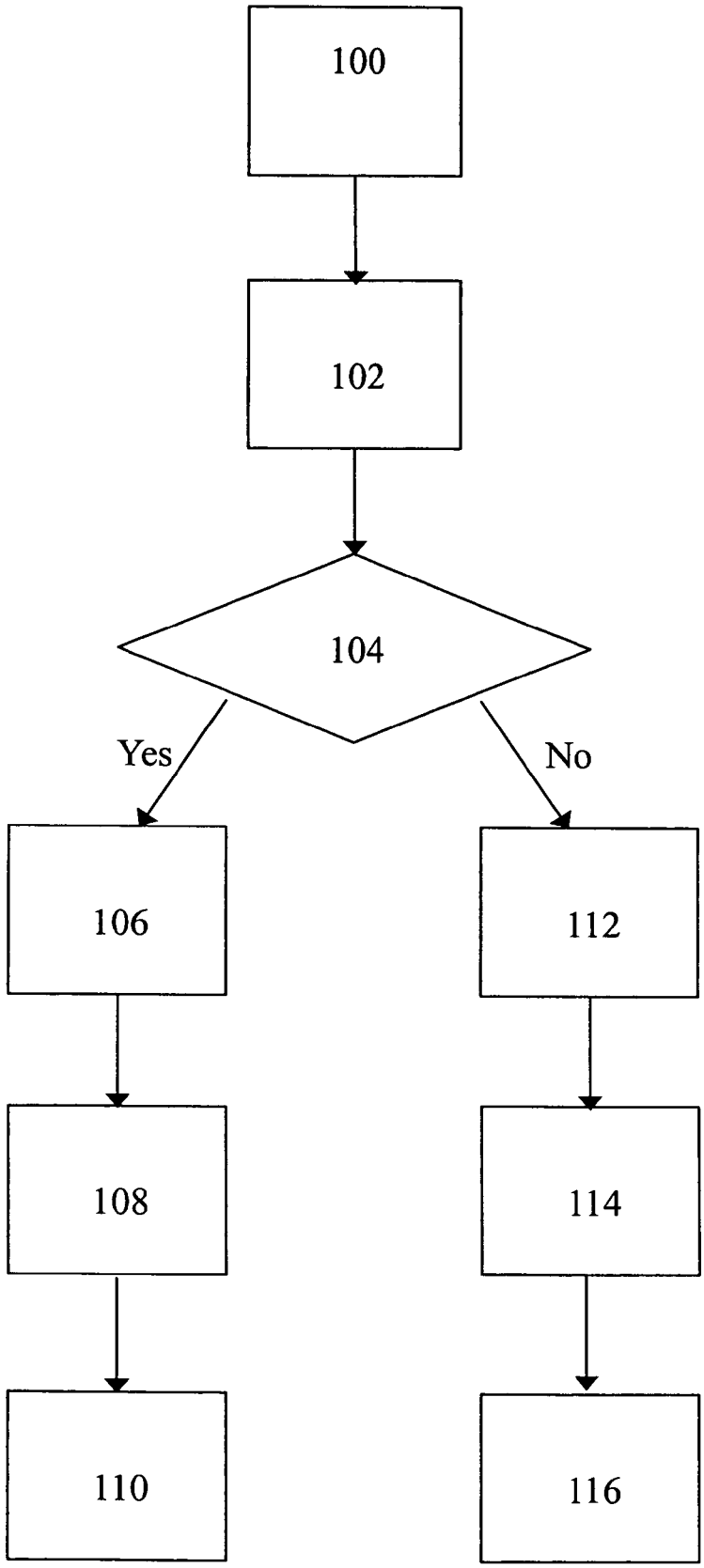
FIG. 3 shows the flow chart for the embodiment of FIG. 2.

We claim:

1. A safety apparatus for preventing industrial safety problems of a machine tool caused in a work-loading process, comprises:

a work-loading device, used for work loading;

an actuator, used for connecting circuits of the machine tool to control an ON-OFF status thereof; and a storing unit, used for setting the work-loading device;

wherein the storing unit will turn on the actuator if the work-loading device is located at a first site previously designated by the storing unit and, therefore, will have the circuits of the machine tool stay in an ON status;

wherein the storing unit will suppress the actuator function if the work-loading device is located in a position other than the first site previously designated by the storing unit and, therefore, will have the circuits of the machine tool stay in a power-OFF status;

wherein the storing unit comprises a fixture to lead and secure the work-loading device at the first site;

wherein the actuator comprises a click-typed ON-OFF switch; and wherein the click-typed ON-OFF switch is set under the fixture of the storing unit, and is activated by the weight of the work-loading device when the work-loading device is returned to the designated safe position on the storing unit.

2. The safety apparatus of claim 1, wherein the circuits of the actuator and the circuit of the machine tool are connected in series so that the ON-OFF switch of the machine tool will paralyze the machine tool operation when the actuator stays in an OFF position.

3. The safety apparatus of claim 1, wherein the actuator comprises a click-typed ON-OFF switch to control the power status of the machine tool.

4. The safety apparatus of claim 1, wherein the fixture is vertically set.

* * * * *